United States Patent [19]

Bock

[11] Patent Number: 4,940,856

[45] Date of Patent: Jul. 10, 1990

[54] ELECTRICAL CONNECTOR

[75] Inventor: Leonard Bock, Wilton, Conn.

[73] Assignee: Burndy Corporation, Norwalk, Conn.

[21] Appl. No.: 371,269

[22] Filed: Jun. 26, 1989

[51] Int. Cl.[5] ..... H01R 4/18

[52] U.S. Cl. ..... 174/94 R; 174/84 C; 174/90; 439/877; 403/281

[58] Field of Search ..... 174/84 C, 90, 94 R; 403/275, 201, 285; 439/877, 878, 880

[56] References Cited

U.S. PATENT DOCUMENTS

| | | | |
|---|---|---|---|
| 1,631,719 | 6/1927 | Chandler | 403/283 |
| 2,930,113 | 2/1960 | Greco | 29/872 |
| 3,053,930 | 9/1962 | Mallanik et al. | 174/94 R |
| 3,156,764 | 11/1964 | Toedtman | 174/94 R |
| 3,235,654 | 2/1966 | Eldridge, Jr. | 174/94 R |
| 3,236,938 | 2/1966 | Toedtman | 174/94 R |
| 3,354,517 | 11/1967 | Levinsky | 403/275 |
| 3,387,080 | 6/1968 | Dibble et al. | 174/94 R |
| 3,408,455 | 10/1968 | Dannes | 439/877 X |
| 3,546,366 | 12/1970 | Toedtman | 174/94 R |
| 3,746,777 | 7/1973 | Peek | 439/877 X |
| 3,781,459 | 12/1973 | Peek | 174/94 R |
| 4,087,889 | 5/1978 | Ohba et al. | 174/84 C |
| 4,310,719 | 1/1982 | Cross et al. | 174/94 R |
| 4,405,827 | 9/1983 | Mixon, Jr. | 174/94 R |
| 4,438,958 | 3/1984 | De Cenzo | 174/945 X |
| 4,723,921 | 2/1988 | Pooley | 439/783 |
| 4,734,062 | 3/1988 | Goto | 439/783 |

*Primary Examiner*—Morris H. Nimmo

*Attorney, Agent, or Firm*—Mitchell B. Wasson; Martin P. Hoffman; Burtsell J. Kerns

[57] ABSTRACT

An electrical connector for connecting a first conductor to a second conductor. The electrical connector includes a generally C-shaped body which defines first and second conductor receiving cavities for accomodating the respective conductors. The body member is provided with an opening communicating with the conductor receiving cavities, by means of which the condutors are adapted to be positioned within the cavities. An integral hingedly connected retaining member is associated with one of the conductor receiving cavities whereby, once a conductor has been placed in the latter cavity, the retaining member may be manually rotated to a position wherein it secured the condcutor in the cavity. The connector is then intended to be placed over a second conductor, such that the second conductor is received in the other conductor receiving cavity. The connector is adapted to be compressed, by means of a compression tool, so as to substantially close the opening in the body member.

12 Claims, 1 Drawing Sheet

ELECTRICAL CONNECTOR

BACKGROUND OF THE INVENTION

1. Field of the Invention

The invention broadly pertains to electrical connectors for wire or cable conductors. More specifically, the invention relates to a compression-type electrical connector for connecting a first conductor to a second conductor in an electrical power distribution system. The invention finds particular application in establishing a tap connection to provide a branch current from a continuous run main power cable. An electrical connector of the aforesaid type is typically adapted to receive a tap conductor, to engage a continuous run conductor, and to be compressed by means of a crimping tool to achieve the desired connection.

In order that the electrical connector may efficiently and safely be installed on the continuous run conductor, it is desirable that it possess a configuration which allows it to be easily hooked onto the run conductor. Additionally, because the run and tap conductors may be fabricated of different metals, it is desirable that the connector isolate the respective conductors from each other so as to prevent rapid galvanic corrosion. Distinctions in the conductors which may be utilized for various applications make it further desirable that the connector accommodate a range of sizes for the respective conductors. Finally, limited access to the run conductor, which is a frequent characteristic of installation conditions, makes it desirable that the electrical connector be adapted for insertion in the compression tool with one of the conductors already installed, and secured, therein, enabling the connector to engage the other conductor and to be compressed immediately.

The present invention accomplishes the foregoing objectives by providing an electrical connector which is specifically configured to accept a wide range of conductor sizes, isolates the conductors from each other to prevent galvanic corrosion, provides a manually deformable member for positively retaining one of the conductors prior to compression, and prior or subsequent to insertion in a compression tool, and is adapted to be easily and quickly applied to the other of the conductors for immediate compression.

2. Description of the Prior Art

U.S. Pat. No. 3,053,930, which issued to Mallanik, et al. on Sept. 22, 1962, and which is commonly owned by the assignee of the subject invention, discloses an electrical connector possessing several features similar to those of the present invention. Mallanik, et al. teaches an electrical connector comprising a generally C-shaped body. A central web is disposed within the interior of the body so as to form an E-shaped configuration which defines an upper and a lower cavity. A tap conductor is intended to be inserted into either of the cavities, whereupon the central web is manually bent down by the installer on top of the tap conductor to lock it in position. The connector, with the tap conductor secured therein, may then be inserted into a compression tool, hooked onto a run conductor, whereby the run conductor is received in the other remaining cavity, and then compressed.

Mallanik, et al. teaches the central web as being formed separate from the body of the conductor and either staked within a groove in the body (FIG. 1), or attached to the body by means of a ball and socket joint (FIG. 4). Both of the latter embodiments, comprising as they do separable body and web members, permit the web members to be formed longer than the body, so that the central web projects from both ends of the body as illustrated in FIG. 1. It is these projecting ends of the web member which are in practice manually grasped by and pushed down upon by the installer to bend the central web down on top of the conductor to be secured in the connector.

Although Mallinick, et al. depicts the central web as being hingedly connected to the body of the connector in FIGS. 2 and 3, the latter embodiments are unitary members, being cut from extruded bars. As such, the ends of the central webs would not project beyond the ends of the body member, but would in fact be the same length as the body member. Consequently, the integral electrical connector having a hinged central web shown by Mallinick, et al. is impractical and, indeed, virtually impossible to utilize in its intended manner for the reason that the installer is unable to bend the central web down on top of the tap conductor. This is so because the installer has no way of grasping the central web, other than through the opening in the body member which, particularly for a lineman installer with gloves on, is too small.

The instant invention provides all of the functional benefits which are associated with the connectors of Mallinick, et al. while overcoming the deficiencies associated therewith.

It is also generally known in the prior art to provide an electrical connector having a body of C-shaped configuration. U.S. Pat. No. 4,087,889 to Ohba, et al., U.S. Pat. No. 1,631,719 to Chandler, U.S. Pat. No. 2,930,113 to Greco and U.S. Pat. No. 3,387,080 to Debble, et al. generally disclose C-shaped connecting devices wherein one or more conductors are intended to be disposed within the open cavity defined by the C shaped connector with the connector being subsequently compressed.

The prior art further discloses electrical connectors for connecting tap and run conductors wherein the conductors are electrically and mechanically retained within a C-shaped body member by means of toggle blocks. For example, U.S. Pat. No. 4,734,062 to Goto, which issued on Mar. 29, 1988, shows an electrical connector comprising a C-shaped body member which defines channels dimensioned to receive a range of sizes of conductors. Once the conductors which are to be connected are placed in the body member, hingedly connected toggle blocks are positioned in the body member. The toggle blocks are intended to be forced into the body member, thereby compressing the conductors in their respective channels and providing an electrical interconnection between same. A similar device is disclosed in U.S. Pat. No. 4,723,921, which issued to Pooley on Feb. 9, 1988.

The prior art fails to teach or suggest an electrical connector including an integral C-shaped body member provided with a movable retaining member that is accessible from outside the cavity defined by the body member, and which may be bent inwardly to retain and isolate a conductor located within the body member.

SUMMARY OF THE INVENTION

The invention pertains to an electrical connector for connecting a first conductor to a second conductor. The electrical connector comprises a body member of generally C-shaped configuration and defining an interior main cavity. The body member is of one-piece construction, including a main body portion which is associated with an upper arm and a lower arm. The upper and lower arms terminate in ends, between which extends an opening communicating with the interior cavity. The main body portion, together with the upper arm, defines a first conductor receiving cavity in the interior of the body member. Similarly, the main body portion, together with the lower arm, defines a second conductor receiving cavity in the interior of the body member. Each of the conductor receiving cavities is generally circular in cross-sectional configuration, and each is adapted to receive a conductor oriented longitudinally therein.

A retaining member is connected at one of its ends to the end of one of the arms, being connected thereto by means of an integral hinge. The retaining member is adapted to be manually rotated around the hinge toward and through the opening in the body member. Rotation of the retaining member in this manner results in its being brought into a position where it effectively secures a conductor that is located within the conductor receiving cavity which has the end of its arm connected to the retaining member.

The electrical connector is intended to be utilized by an installer manually positioning a first conductor longitudinally within the conductor receiving cavity that has its arm connected to the retaining member. While holding the conductor within his hand, the installer, utilizing the fingers of the same hand, rotates the retaining member toward and through the opening in the body member so that the retaining member secures the first conductor within its cavity. The connector is then intended to be inserted into a compression tool and positioned over a second conductor, so that the second conductor is longitudinally positioned within the other conductor receiving cavity. The conductor is then compressed, by means of the tool, causing the upper and lower arms to be brought together, and the opening between them closed.

DESCRIPTION OF THE PREFERRED EMBODIMENT

Figure 1:
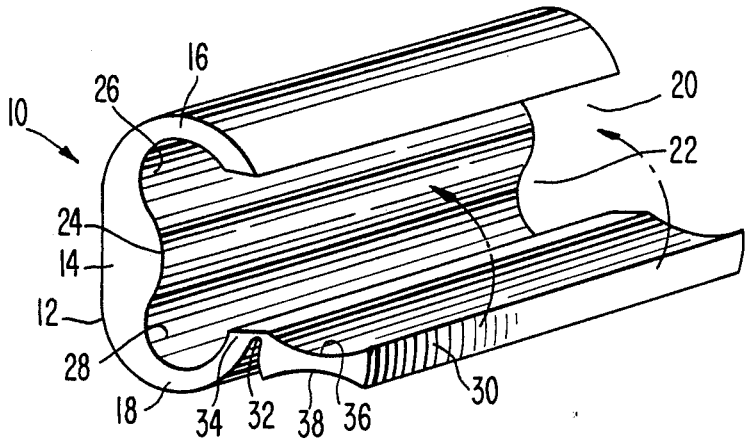
FIG. 1 is a perspective view of the electrical connector of the present invention.

With reference to the drawing, and with particular reference to FIG. 1, the invention pertains to an electrical connector, indicated generally at 10. The electrical connector 10 comprises a connector body member 12 of generally C-shaped configuration. The body member 12 is defined by a main body portion 14, upper arm 16, and a lower arm 18. An opening 20 extends between the upper and lower arms, communicating with the cavity 22 in the interior of the body member.

The main body portion 14 is formed with a central enlargement 24 which, together with upper arm 16 defines an upper conductor receiving cavity 26, and together with lower arm 18 defines a lower conductor receiving cavity 28. The main body portion and the upper and lower arms are dimensioned so that the conductor receiving cavities formed thereby are capable of accommodating a wide range of conductor sizes.

A retaining member 30 is connected by means of an integral hinge 32 to the terminal end 34 of the lower arm 18. The retaining member 30 is formed with a curved inner surface 36 and a curved outer surface 38.

The body member 12, together with the integral retaining member 30, is preferably cut from an extruded aluminum bar, aluminum being the preferred material due to its ability to resist galvanic corrosion.

Figure 2:
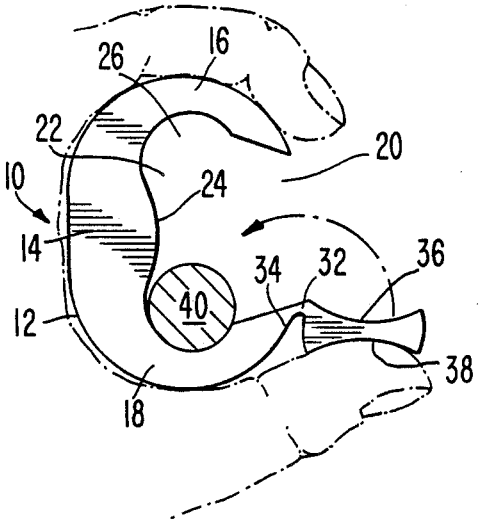
FIG. 2 is a side plan view of the electrical connector, with the fingers of an installer's hand and a tap conductor being depicted in phantom.
Figure 3:
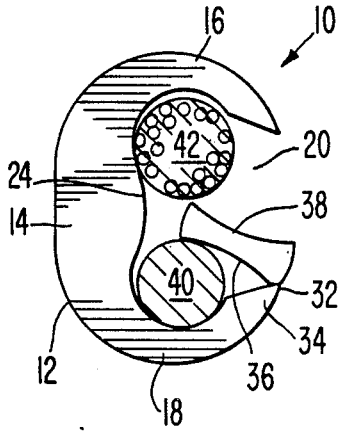
FIG. 3 is a side plan view of the electrical connector, with the retaining member being shown as it appears after it has been manually bent in toward the body of the connector.

In operation, a tap conductor 40, shown in phantom in FIG. 2, is positioned by the installer in the lower conductor receiving cavity 28. While holding the electrical connector in one hand, as depicted in phantom in FIG. 2, the installer, using the fingers of the same hand, rotates the retaining member 30 upwardly around the hinge 32 toward the opening 20 and into the cavity 22 in the interior of the body member. In its fully rotated position, as shown in FIG. 3, the retaining member retains and secures the tap conductor in the lower conductor receiving cavity. The curved outer surface of the retaining member conforms to the shape of the installer's finger pressing against the retaining member. The curved inner surface of the retaining member conforms to the shape of the conductor which it retains.

The electrical connector, together with the secured tap conductor, is then intended to be inserted into a suitable compression tool (not shown) and hooked onto a run conductor. As illustrated in FIG. 3, the electrical connector is adapted to engage run conductor 42 through the opening 20 between the arms of the body member so that the run conductor is received within the upper conductor receiving cavity 26. The electrical connector may then be immediately compressed by means of the tool so that the arms 16 and 18 are brought toward each other, closing the opening 20.

It can be seen, therefore, that the electrical connector of the present invention is characterized by a unique retaining member 30 which serves the dual function of securing the tap conductor in position prior to compression, as well as separating the tap and run conductors from each other. Isolation of the two conductors, as provided for by the retaining member 30, deters galvanic corrosion in instances where the tap and run conductors are respectively formed of different metals. Moreover, the subject one-piece electrical connector is uniquely adapted to be fabricated from an integral extrusion, and is capable of accepting a wide range of conductor sizes. The present electrical connector achieves the foregoing attributes while being easily operated and installed in the field by a lineman using only one hand and under conditions of limited access.

Although the invention has been described herein in conjunction with a preferred embodiment, it should be understood that various modifications and additions may be made to the invention without departing from the spirit and scope of the invention as defined by the appended claims.

What is claimed is:

1. An electrical connector comprising a body member of substantially C-shaped configuration, said body member being defined by a main body portion, an upper arm, and a lower arm, said upper and lower arms each terminating in an end, an opening extending between said ends of said upper and lower arms, said opening communicating with the interior of said body member, said main body portion and said upper arm together defining an upper conductor receiving cavity, said main body portion and said lower arm together defining a lower conductor receiving cavity, each of said conductor receiving cavities being adapted to receive a conductor positioned longitudinally in said electrical connector, and at least one integral retaining member connected at one of its ends to the end of one of said ends of said arms, said retaining member being adapted to be manually rotated toward and through said opening so as to retain a conductor which is positioned in the conductor receiving cavity associated with the end of the arm to which said retaining member is secured.

2. The electrical connector recited in claim 1, wherein said main body portion has an interior surface facing said opening, an enlargement being provided on said interior surface so as to define, together with said arms, said conductor receiving cavities.

3. The electrical connector recited in claim 1, wherein said body member, together with said retaining member, is fabricated from an integral extrusion.

4. The electrical connector recited in claim 3, wherein said extrusion is formed of aluminum.

5. The electrical connector recited in claim 1, wherein said retaining member has an interior surface and an exterior surface, said interior and exterior surfaces of said retaining member being curved.

6. The electrical connector recited in claim 1, wherein said body member is deformable, the ends of said arms of said body member being adapted to be brought toward each other when said body member is compressed.

7. The electrical connector recited in claim 1, wherein said retaining member is connected to one of said ends of said arms by means of an integral hinge.

8. An electrical connector comprising an integral, deformable body member of substantially C-shaped configuration and defining an interior main cavity, said body member including a main body portion, an upper arm and a lower arm, said upper and lower arms each terminating in an end, an opening extending between said ends of said upper and lower arms, said opening communicating with said main cavity, said main body portion having an interior surface facing said cavity, an enlargement provided on said interior surface, said main body portion and said upper arm together defining an upper conductor receiving cavity located above said enlargement, said main body portion and said lower arm together defining a lower conductor receiving cavity located below said enlargement, each of said conductor receiving cavities being of generally circular cross-sectional configuration, each of said conductor receiving cavities being adapted to receive a conductor positioned longitudinally in said body member, and an integral retaining member hingedly connected to one of said ends of said arms, said retaining member being adapted to be manually rotated around said hinge toward and through said opening so as to retain a conductor which is positioned in the conductor receiving cavity associated with the end of the arm to which said retaining member is secured.

9. The electrical connector recited in claim 8, wherein said body member, together with said hinge, is cut from an aluminum extrusion.

10. The electrical connector recited in claim 8, wherein said body member is deformable, the ends of said arms being adapted to be brought toward each other when said upper and lower arms are compressed.

11. A method of connecting a first conductor to a second conductor using an electrical connector characterized by an integral generally C-shaped body member having a main body portion and upper and lower arms, an opening extending between said upper and lower arms and communicating with the interior of said body member, said body member and said upper arm defining an upper conductor receiving cavity, said body member and said lower arm defining a lower conductor receiving cavity, a retaining member integrally and hingedly connected at one end to one of said ends of said arms, said method comprising the steps of:

(a) manually positioning a first conductor longitudinally within said conductor receiving cavity which has said end of its arm connected to said retaining member;

(b) manually rotating said retaining member toward and through said opening so that said retaining member secures said first conductor within said cavity;

(c) manually placing said connector on a second conductor so that said second conductor is longitudinally disposed with the conductor receiving cavity which does not have the end of its arm connected to the retaining member; and (d) compressing said connector by means of a compression tool so as to bring said upper and lower arms together and closing said opening between said arms.

12. The method recited in claim 11 further comprising the step of manually placing said connector, with said first conductor secured therein, into said compression tool prior to placing said connector on said second conductor.

* * * * *